US008191382B2

(12) United States Patent
Lim et al.

(10) Patent No.: US 8,191,382 B2
(45) Date of Patent: Jun. 5, 2012

(54) REFRIGERATOR HAVING A SWITCHING COMPARTMENT AND CONTROLLING METHOD FOR THE SAME

(75) Inventors: Hyoung Keun Lim, Seoul (KR); Yeon Woo Cho, Seoul (KR); Gye Young Song, Seoul (KR)

(73) Assignee: LG Electronics Inc., Seoul (KR)

( * ) Notice: Subject to any disclaimer, the term of this patent is extended or adjusted under 35 U.S.C. 154(b) by 895 days.

(21) Appl. No.: 12/252,973

(22) Filed: Oct. 16, 2008

(65) Prior Publication Data

US 2009/0133432 A1 May 28, 2009

(30) Foreign Application Priority Data

Nov. 5, 2007 (KR) ..... 10-2007-0112259

(51) Int. Cl.
*F25D 11/02* (2006.01)

(52) U.S. Cl. ..... 62/441

(58) Field of Classification Search ..... 62/441, 62/264, 419
See application file for complete search history.

(56) References Cited

U.S. PATENT DOCUMENTS

| | | | | |
|---|---|---|---|---|
| 4,002,199 | A | | 1/1977 | Jacobs |
| 4,618,193 | A | | 10/1986 | Cuthbert et al. |
| 5,228,499 | A | * | 7/1993 | Yoon ..... 165/263 |
| 5,368,379 | A | | 11/1994 | Wrangberth |
| 5,392,615 | A | * | 2/1995 | Lim ..... 62/414 |
| 5,829,767 | A | | 11/1998 | Grossman |
| 5,947,197 | A | | 9/1999 | Lee |
| 6,158,257 | A | | 12/2000 | Ryan et al. |
| 6,618,887 | B2 | | 9/2003 | Kim et al. |
| 6,732,552 | B2 | | 5/2004 | Kim et al. |
| 7,748,682 | B2 | | 7/2010 | Hunke et al. |
| 7,976,111 | B2 | | 7/2011 | Sans Rovira et al. |
| 2002/0017117 | A1 | | 2/2002 | Sunshine et al. |
| 2002/0056293 | A1 | | 5/2002 | Kin et al. |
| 2002/0153816 | A1 | | 10/2002 | Banicevic et al. |
| 2004/0134237 | A1 | | 7/2004 | Sunshine et al. |
| 2004/0226320 | A1 | | 11/2004 | Bongini |
| 2005/0150523 | A1 | | 7/2005 | Schock |
| 2005/0172678 | A1 | | 8/2005 | Kim et al. |
| 2005/0178165 | A1 | | 8/2005 | Carey et al. |
| 2006/0103281 | A1 | | 5/2006 | Cho |
| 2006/0112737 | A1 | | 6/2006 | Sunshine et al. |
| 2006/0130518 | A1 | | 6/2006 | Kang |
| 2006/0130535 | A1 | | 6/2006 | Sunshine et al. |

(Continued)

FOREIGN PATENT DOCUMENTS

CN 2256089 6/1997

(Continued)

OTHER PUBLICATIONS

Chinese Office Action dated Aug. 22, 2011 (Application No. 200880024934.1).

(Continued)

*Primary Examiner* — Melvin Jones
(74) *Attorney, Agent, or Firm* — KED & Associates, LLP

(57) ABSTRACT

A refrigerator includes a refrigerating compartment, a freezing compartment, and a switching compartment to store food items. Various elements are provided to maintain the three compartments at selected target temperatures. A heater and/or a light source may be provided to rapidly heat the switching compartment when the switching compartment is being changed from a freezing operation to a refrigerating operation.

23 Claims, 5 Drawing Sheets

U.S. PATENT DOCUMENTS

| | | | |
|---|---|---|---|
| 2006/0156765 | A1 | 7/2006 | Sunshine et al. |
| 2007/0075614 | A1 | 4/2007 | Calmeise |
| 2007/0249212 | A1 | 10/2007 | Buecker et al. |
| 2009/0146536 | A1 | 6/2009 | Kim et al. |

FOREIGN PATENT DOCUMENTS

| | | |
|---|---|---|
| CN | 1542208 | 11/2004 |
| DE | 1 135 408 | 8/1962 |
| DE | 2034848 | 1/1972 |
| DE | 2703215 | 8/1978 |
| DE | 298 11 701 U1 | 11/1999 |
| DE | 19838631 | 3/2000 |
| DE | 19956973 | 8/2000 |
| DE | 203 02 572 | 5/2003 |
| DE | 10 2005 053 554 | 10/2006 |
| EP | 1 108 810 | 6/2001 |
| EP | 1 233 100 | 8/2002 |
| EP | 1 491 676 | 12/2004 |
| EP | 1 528 141 | 5/2005 |
| EP | 1 577 434 | 9/2005 |
| EP | 1 726 703 | 11/2006 |
| JP | 04-184077 | 7/1992 |
| JP | 2001-116421 | 4/2001 |
| JP | 2005-172298 | 6/2005 |
| JP | 2007-212053 | 8/2007 |
| WO | WO 2004/055254 | 7/2004 |

OTHER PUBLICATIONS

U.S. Office Action issued in U.S. Appl. No. 12/122,245 dated Jun. 30, 2011.

U.S. Office Action issued in U.S. Appl. No. 12/122,044 dated Jul. 20, 2011.

International Search Report and the Written Opinion of the International Searching Authority issued in PCT/KR2008/005686 dated Mar. 22, 2010.

European Search Report dated Apr. 1, 2010. (Application No. 09015496.4-2314).

International Search Report and Written Opinion issued in Application No. PCT/KR2008/0027252 dated Aug. 5, 2010.

International Search Report and Written Opinion issued in PCT/KR 2008/002751 dated Aug. 16, 2010.

International Search Report dated Nov. 3, 2010 (Application No. PCT/KR2008/002725).

U.S. Office Action issued in U.S. Appl. No. 12/122,258 dated Jan. 21, 2011.

U.S. Office Action issued in U.S. Appl. No. 12/122,245 dated Feb. 23, 2011.

European Search Report dated May 23, 2011. (Application No. 08753521.7-2314).

* cited by examiner

REFRIGERATOR HAVING A SWITCHING COMPARTMENT AND CONTROLLING METHOD FOR THE SAME

BACKGROUND

1. Field

The present disclosure relates to a food storage apparatus, and more particularly, to a refrigerator capable of efficiently maintaining target temperatures in multiple different food storing chambers.

2. Background

A representative example of widely used food storage apparatuses is a refrigerator like the one shown in FIG. 1. Generally, a refrigerator includes a freezing compartment 20 and a refrigerating compartment 10. The refrigerating compartment 10 is kept at a temperature of approximately 3° C. to 4° C., to keep food and vegetables fresh for a long time. The freezing compartment 20 is kept at a sub-zero temperature, to keep food, meat, etc., in a frozen state. A refrigerator usually includes at least one evaporator that supplies cold air into the refrigerating compartment and the freezing compartment, selectively or simultaneously.

As will be understood, if the amount of food to be kept in a chilled state exceeds a predetermined capacity of the refrigerating compartment, the food cannot be efficiently kept in the chilled state. Similarly, if the amount of food to be kept in a frozen state exceeds a predetermined capacity of the freezing compartment, the food cannot be efficiently kept in the frozen state.

BRIEF DESCRIPTION OF THE DRAWINGS

The embodiments will be described in detail with reference to the following drawings, in which like reference numerals refer to like elements, and wherein.

DETAILED DESCRIPTION

Figure 1:
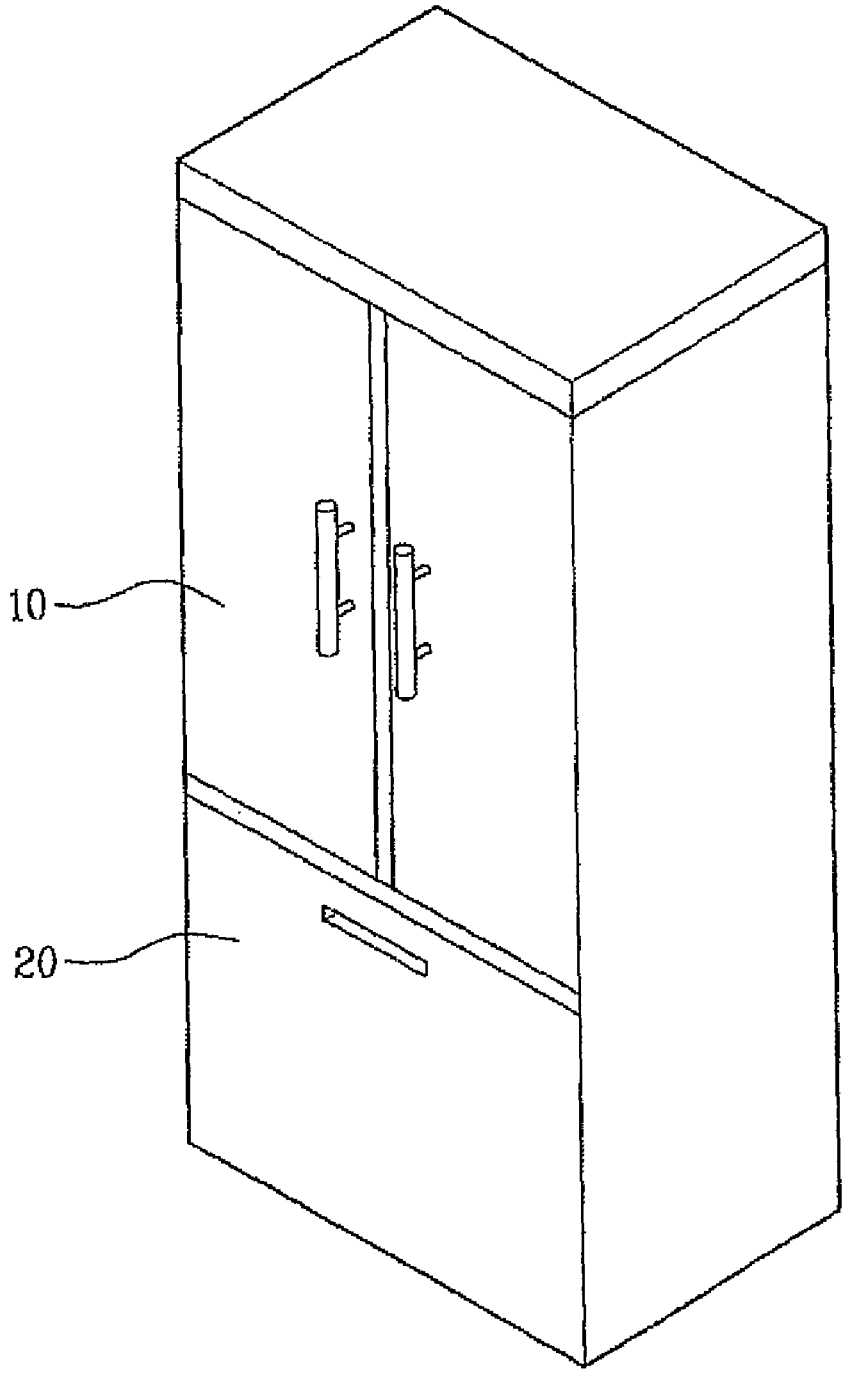
FIG. 1 RELATED ART
FIG. 1 is a perspective view illustrating a related art refrigerator.
Figure 2:
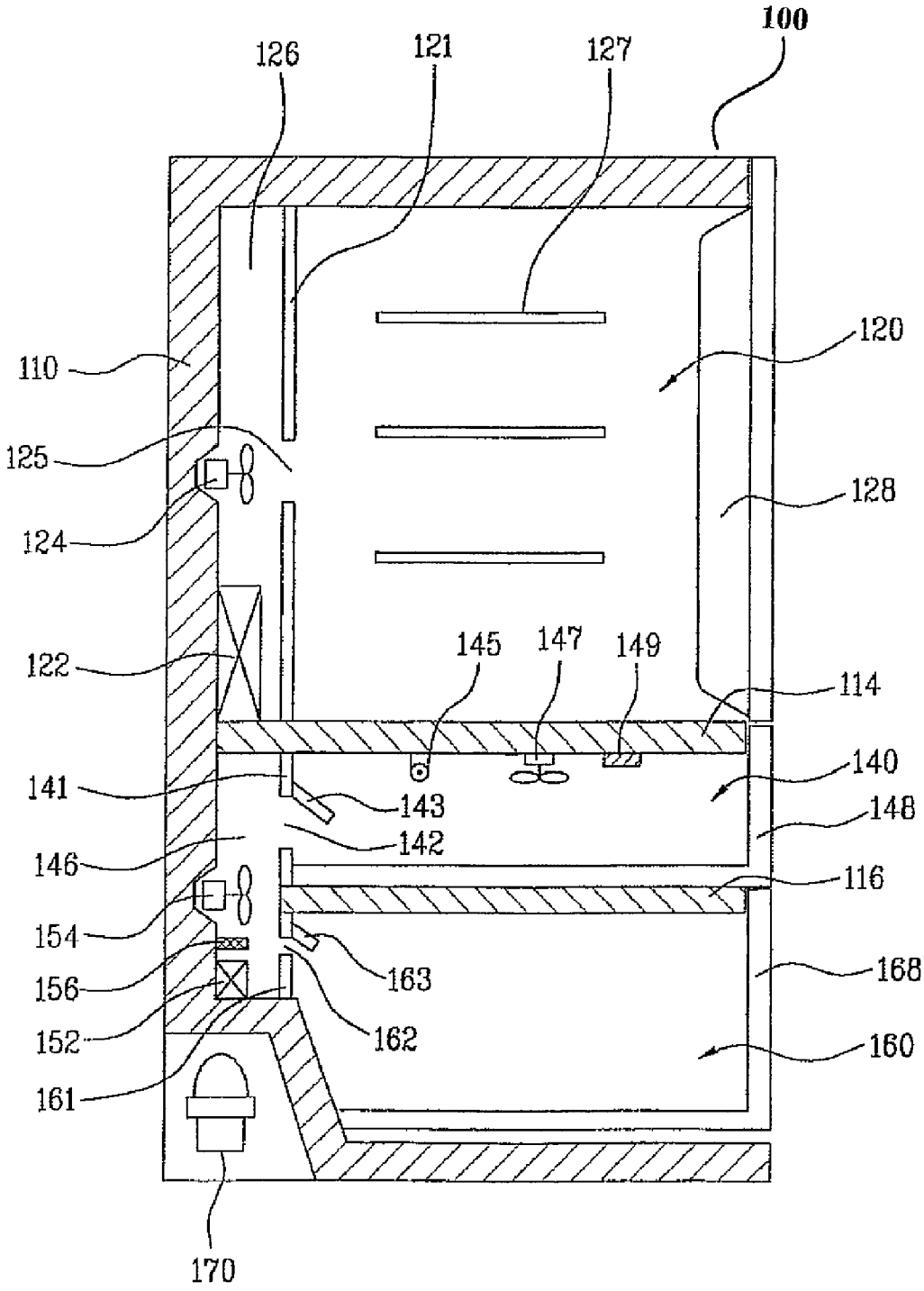
FIG. 2 is a side sectional view of the refrigerator shown in FIG. 1.

The configuration of a first embodiment of a refrigerator will be described with reference to FIG. 2. The refrigerator according to the first embodiment includes a body 100, a refrigerating compartment 120 and a freezing compartment 160 defined separately in the body 100. A switching compartment 140 is located between the refrigerating and freezing compartments. The switching compartment is capable of maintaining different preset temperatures that range between a refrigerating temperature and a freezing temperature.

The refrigerating compartment 120 is provided at a front surface thereof with one or more refrigerating compartment doors 128 to open or close the refrigerating compartment 120. Also, the refrigerating compartment 120 incorporates shelves 127 to support contents at multiple levels. A dispenser to discharge certain contents such as water or ice can be installed at a front surface of one of the refrigerating compartment doors.

The freezing compartment 160 is provided at a front surface thereof with a freezing compartment door 168 to open or close the freezing compartment 160. Also, the switching compartment 140 is provided at a front surface thereof with a switching compartment door 148 to open or close the switching compartment 140.

The body 100 has a rear wall 110 extending at the rear side of the refrigerating compartment 120, the freezing compartment 160, and the switching compartment 140. In this embodiment, the refrigerating compartment 120 is located above the switching compartment 140, and the freezing compartment 160 is located below the switching compartment 140. In other embodiments, the various chambers could have different relative arrangements.

Likewise it will be appreciated that the doors of the freezing compartment and the refrigerating compartment may be changed according to the arrangement of the freezing compartment and the refrigerating compartment. For example, the refrigerator may be a top-mount type or double-door type refrigerator, or the like.

A first partition 114 is installed between the switching compartment 140 and the refrigerating compartment 120. The first partition 114 serves not only to separate the switching compartment 140 and the refrigerating compartment 120 from each other, but also to prevent the transfer of heat between the switching compartment 140 and the refrigerating compartment 120.

A second partition 116 is installed between the switching compartment 140 and the freezing compartment 160. The second partition 116 serves not only to separate the switching compartment 140 and the freezing compartment 160 from each other, but also to prevent the transfer of heat between the switching compartment 140 and the freezing compartment 160. Although the first and second partitions 114 and 116 may be made of the same material, the first and second partitions 114 and 116 could also be made of different materials.

A first duct 126 is defined between the rear wall 110 of the body 100 and a rear wall 121 of the refrigerating compartment 120. Also, a second duct 146 is defined between the rear wall 110 of the body 100, a rear wall 161 of the freezing compartment 160, and a rear wall 141 of the switching compartment 140. The first duct 126 and the second duct 146 are separated from each other by the first partition 114.

The first duct 126 incorporates a first evaporator 122 and a first blowing fan 124, which are used to perform a refrigerating operation for the refrigerating compartment 120. The second duct 146 incorporates a second evaporator 152 and a second blowing fan 154, which are used to perform a freezing operation for the freezing compartment 160, or a refrigerating or freezing operation for the switching compartment 140.

More specifically, the second evaporator 152 and the second blowing fan 154 are used to cool both the freezing compartment 160 and the switching compartment 140. The freezing compartment 160 and the switching compartment 140 can communicate with each other via the second duct 146.

The second duct 146 may further incorporate a heater 156 to perform a defrosting operation on the second evaporator 152, or to help quickly warm the switching compartment. The heater 156 can be operated to supply heat into the switching compartment 140 when the switching compartment 140 is switched from a freezing operation to a refrigerating operation.

The rear wall 121 of the refrigerating compartment 120 is perforated with at least one discharge hole 125, to allow the first duct 126 to communicate with an inner space of the refrigerating compartment 120. Cold air generated from the first evaporator 122 is guided into the refrigerating compartment 120 through the refrigerating compartment discharge hole 125.

Similarly, the rear wall 161 of the freezing compartment 160 is perforated with at least one discharge hole 162, and the rear wall 141 of the switching compartment 140 is perforated with at least one discharge hole 142. Also, the rear wall 141 of the switching compartment 140 is provided with at least one first damper 143 to open or close the switching compartment discharge hole(s) 142, and the rear wall 161 of the freezing compartment 160 is provided with at least one second damper 163 to open or close the freezing compartment discharge hole(s) 162.

The first damper 143 serves to selectively supply cold air generated from the second evaporator 152 and heat generated from the heater 156 into the switching compartment 140. For example, when the switching compartment 140 performs a refrigerating operation, the first damper 143 guides cold air into the switching compartment 140. On the other hand, when the switching compartment 140 is switched from a freezing operation to a refrigerating operation, the first damper 143 guides heated air into the switching compartment 140.

Similarly, the second damper 163 serves to selectively supply cold air generated in the second duct 146 into the freezing compartment 160. For example, when the switching compartment 140 is switched from a freezing operation to a refrigerating operation, the second damper 163 closes the freezing compartment discharge hole 162. This is because the heater 156 is operated to generate heat in the second duct 146 while the switching compartment 140 is switched from a freezing operation to a refrigerating operation.

Meanwhile, the switching compartment 140 incorporates therein a light source 145, which can be used to help raise the interior temperature of the switching compartment 140 while preventing a rapid temperature variation when the switching compartment 140 is switched from a freezing operation to a refrigerating operation. The light source 145 is installed in the switching compartment 140, to irradiate light throughout the inner space of the switching compartment 140. The light source 145 may be selected from an incandescent lamp, an infrared lamp, a halogen lamp, etc. The light source 145 can irradiate light throughout the inner space of the switching compartment 140 until the interior temperature of the switching compartment 140 reaches a preset temperature, regardless of the opening and closing of the switching compartment 140.

For example, when the switching compartment is switched from a freezing operation to a refrigerating operation, the light source 145 installed in the switching compartment 140 is kept in an on-state, regardless of the opening and closing of the switching compartment. Of course, if the interior temperature of the switching compartment 140 reaches a preset refrigeration-storage temperature for keeping food in a chilled state, the light source is turned off, and thereafter only operates when the switching compartment 140 is opened.

The light source 145 has no special limit in the installation position thereof. For example, the light source can be installed at any one of an upper surface, a lower surface, and a side surface of the switching compartment 140. Further, some embodiments may include a first light source used primarily for illumination, and a second light source used primarily to heat the switching chamber. In these embodiments, the first and second light sources could be of different types.

The switching compartment 140 may further incorporate a circulating fan 147, to circulate air streams in the switching compartment 140. More specifically, at least one circulating fan can be installed in the switching compartment 140, and the circulating fan 147 has no special limit in the installation position thereof so long as it is installed in the switching compartment 140.

The switching compartment 140 may further incorporate a temperature sensor 149 to measure the interior temperature of the switching compartment 140. On the basis of the temperature measured by the temperature sensor 149, the operation of the heater 156 and the light source 145 is controlled by a controller (not shown).

Figure 3:
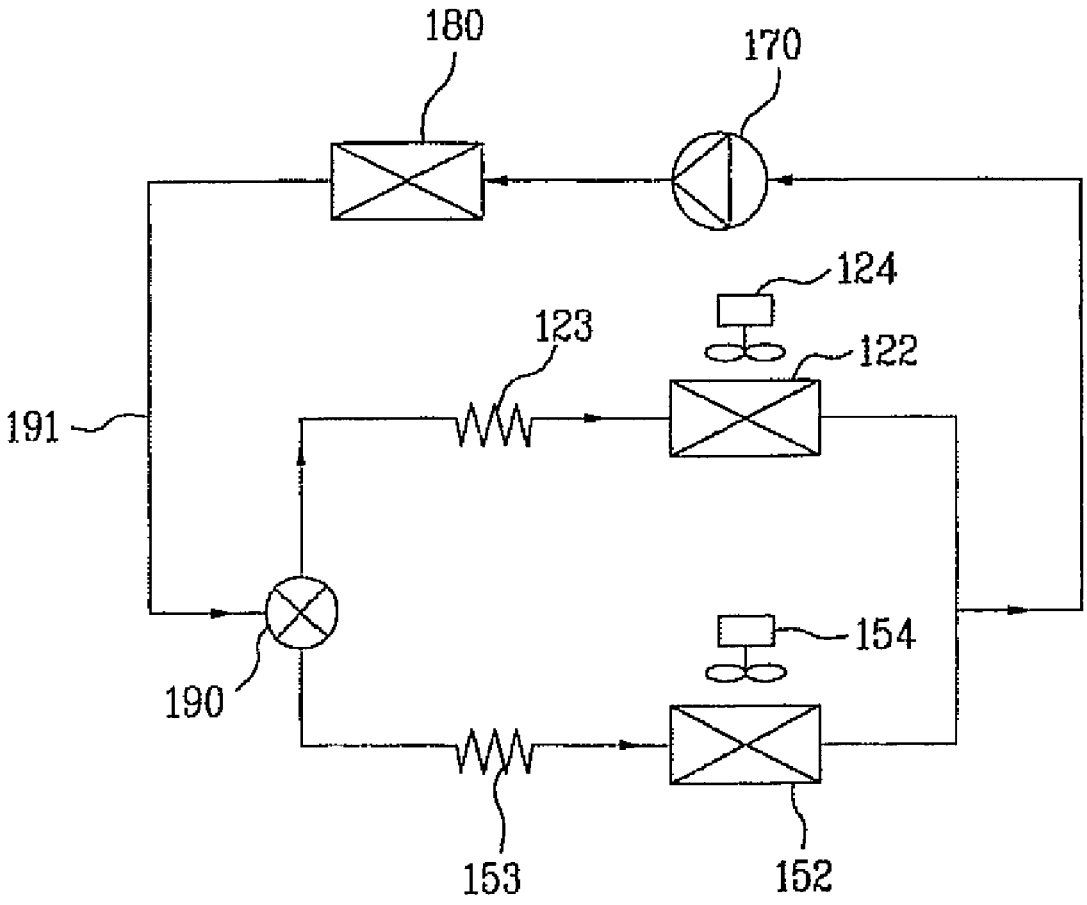
FIG. 3 is a schematic diagram illustrating elements used to produce cool air of the refrigerator shown in FIG. 1.

Hereinafter, the operating sequence of the refrigerator according to the present embodiment will be described in brief, on the basis of the flow of the refrigerant, with reference to FIG. 3.

The refrigerator includes a compressor 170, a condenser 180, a refrigerant tube 191, a refrigerant control valve 190, expanders, evaporators, and blowing fans. The compressor 170 serves to compress a refrigerant, and the condenser 180 serves to lower the temperature of the compressed refrigerant, thereby condensing the compressed refrigerant. The refrigerant tube 191 serves as a flow path to guide the flow of a refrigerant within the refrigerator.

The refrigerant control valve 190 is installed on the refrigerant tube 191, and serves to control the flow of the refrigerant so as to allow a refrigerating operation for the refrigerating compartment 120 and a freezing operation for the freezing compartment 160 to be performed simultaneously or selectively. When two evaporators are connected to a single compressor, a three-way valve is mainly used as the refrigerant control valve 190.

When the refrigerant control valve 190 guides the refrigerant into the refrigerating compartment 120, the refrigerant, having passed through the refrigerant control valve 190, is introduced into a first expander 123 used to expand the refrigerant, thereby further lowering its temperature, before the refrigerant is introduced into the first evaporator 122. Similarly, when the refrigerant control valve 190 guides the refrigerant into the freezing compartment 160, the refrigerant is introduced into a second expander 153, which is used to expand the refrigerant before it is introduced into the second evaporator 152.

The first blowing fan 124 provided at a side of the first evaporator 122 acts to assure an efficient heat exchange by the first evaporator 122, i.e. a heat exchange between the refrigerant and the surrounding air. Similarly, the second blowing fan 154 provided at a side of the second evaporator 152 acts to facilitate a heat exchange by the second evaporator 152.

A process of switching from a freezing operation to a refrigerating operation of the switching compartment will now be described. First, a freezing operation for the switching compartment is completed, i.e. the operation of the second evaporator is stopped. The first damper opens the switching compartment discharge hole and the second damper closes the freezing compartment discharge hole. Thereafter, the heater incorporated in the second duct is operated, to generate heat in the second duct. The first damper guides heated air into the switching compartment. Simultaneously, any light source incorporated in the switching compartment is kept in an on-state. Of course, the light source may be operated regardless of the operation of the heater. The circulating fan within the switching compartment is operated to circulate air streams in the switching compartment.

The temperature sensor continuously measures the interior temperature of the switching compartment. If the temperature measured by the temperature sensor reaches a preset temperature, i.e. a preset refrigeration-storage temperature, the operation of the heater and the light source is stopped, and the switching compartment discharge hole is closed by the first damper under control of the controller.

A second embodiment will now be described with reference to FIG. 4. The refrigerator according to the second embodiment includes a third evaporator. This allows the freezing chamber and the switching chamber to each utilize a dedicated, separate evaporator.

More specifically, a switching compartment duct 246 is defined between the rear wall 110 of the body 100 and a rear wall 241 of the switching compartment. The switching compartment duct 246 incorporates a switching compartment evaporator 252, a switching compartment blowing fan 254, a switching compartment heater 256, and a switching compartment damper 243. Similar to the above described embodiment, the switching compartment incorporates therein the light source 145, the circulating fan 147, and the temperature sensor 149.

Also, a freezing compartment duct 266 is defined between the rear wall 110 of the body 100 and a rear wall 261 of the freezing compartment. The freezing compartment duct 266 incorporates a freezing compartment evaporator 262. The freezing compartment duct 266 is separated from the switching compartment duct 246, and consequently, an operation for the freezing compartment can be performed independently, regardless of an operation for the switching compartment. This means that the freezing compartment could be cooled at the same time that the switching compartment is being heated.

Figure 4:
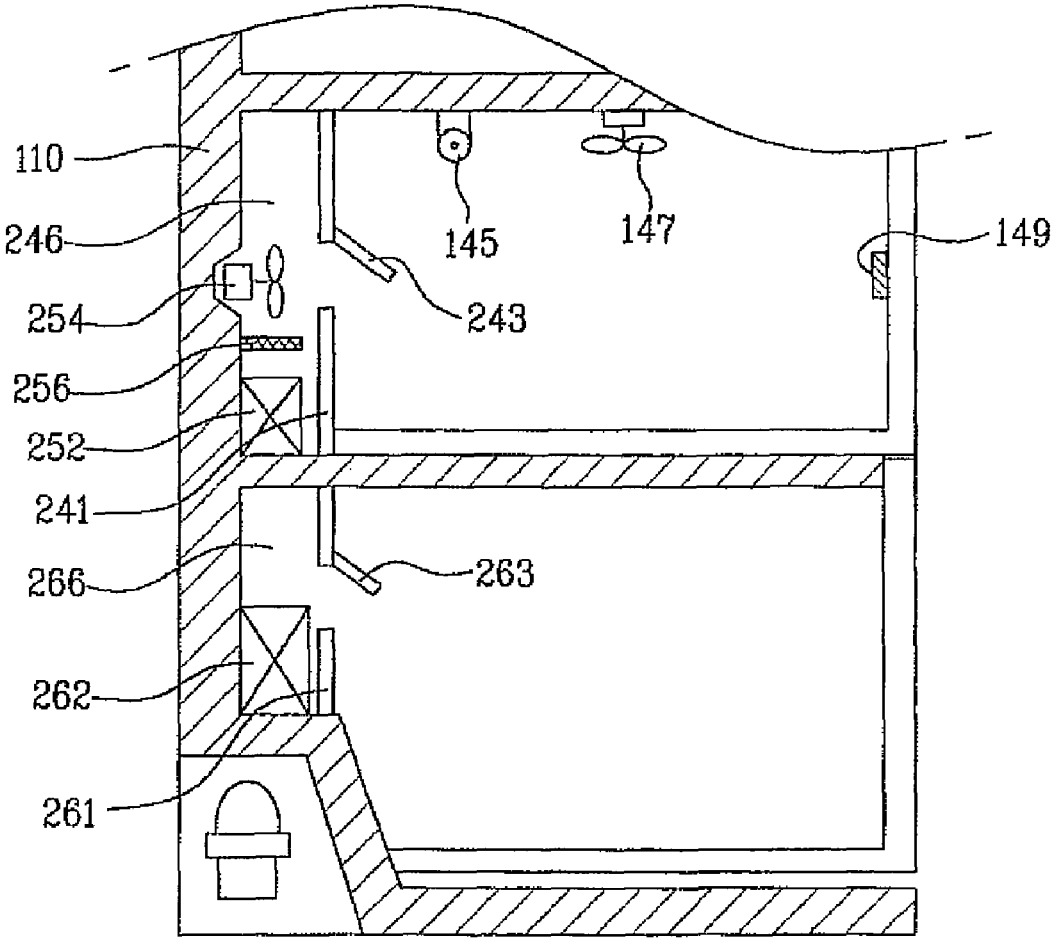
FIG. 4 is a side sectional view illustrating another embodiment of a refrigerator.

In the embodiment shown in FIG. 4, a damper is provided at the inlet to the switching and freezing chambers. However, because each chamber has its own evaporator, these dampers may be eliminated in some embodiments. In yet other embodiments, there may be a damper in one of the switching and freezing compartments, and one may be lacking in the other compartment.

Figure 5:
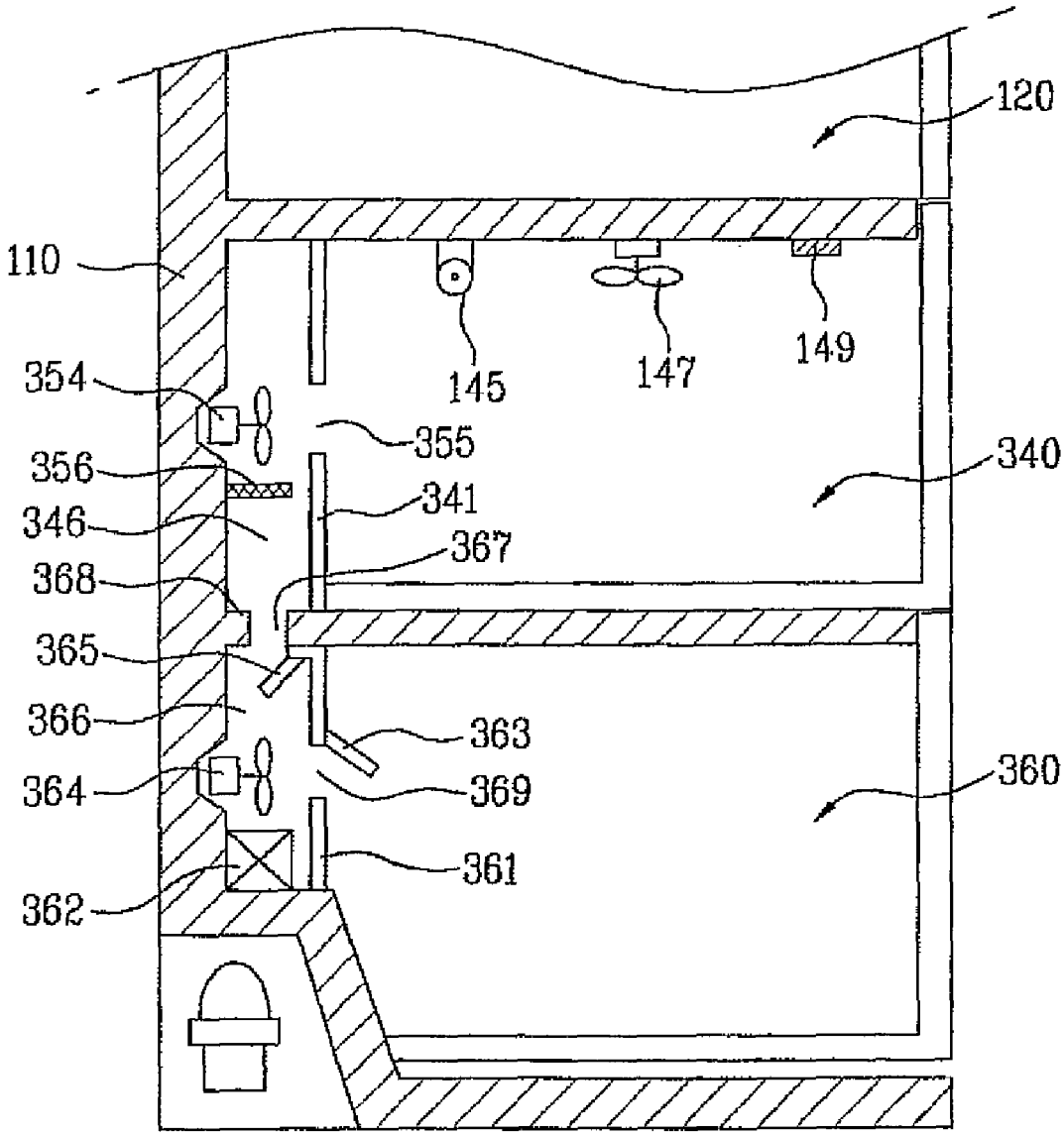
FIG. 5 is a side sectional view illustrating yet another embodiment of a refrigerator.

Next, a refrigerator according to yet another embodiment will be described with reference to FIG. 5. Similar to the above described embodiments, the refrigerator according to this embodiment includes a freezing compartment 360, and a switching compartment 340.

In this embodiment, a freezing compartment duct 366 is defined between the rear wall 110 of the body 100 and a rear wall 361 of the freezing compartment 360. The freezing compartment duct 366 incorporates a freezing compartment evaporator 362 to perform a freezing operation for the freezing compartment 360, and for the switching compartment 340. The freezing compartment duct 366 also incorporates a blowing fan 364 to circulate cold air generated from the evaporator 362 into the freezing compartment 360, and possibly also into the switching compartment 340. In some embodiments, a separate blowing fan 354 will also be provided to blow air into the switching compartment.

The rear wall 361 of the freezing compartment 360, which is provided to separate the freezing compartment 360 from the freezing compartment duct 366, is perforated with at least one discharge hole 369 to allow the freezing compartment 360 to communicate with the freezing compartment duct 366. Also, the rear wall 361 of the freezing compartment 360 is provided with a damper 363 to open or close the freezing compartment discharge hole 369.

Meanwhile, a switching compartment duct 346 is defined between the rear wall 110 of the body 100 and a rear wall 341 of the switching compartment 340. The switching compartment duct 346 is separated from the freezing compartment duct 366 by a partition 368. The partition 368 is perforated with a connecting hole 367 to allow the switching compartment duct 346 to communicate with the freezing compartment duct 366. Also, the partition 368 is provided with a duct damper 365 to open or close the connecting hole 367.

The switching compartment duct 346 incorporates a heater 356 to supply heat into the switching compartment 340. Also, the switching compartment duct 346 incorporates a blowing fan 354, to supply heated air generated from the heater 356 into the switching compartment 340, or to supply cold air generated from the freezing compartment evaporator 362 into the switching compartment 340. As noted above, in some embodiments, the blowing fan 354 may be eliminated.

The rear wall 341 of the switching compartment 340, which is provided to separate the switching compartment 340 from the switching compartment duct 346, is perforated with at least one discharge hole 355 to allow the switching compartment 340 to communicate with the switching compartment duct 346. Similarly, the rear wall 341 of the switching compartment 340 may be provided with a switching compartment damper (not shown), to open or close the switching compartment discharge hole 355. The switching compartment 340 incorporates the light source 145, the circulating fan 147, and the temperature sensor 149.

An operation for switching from a freezing operation for both the freezing compartment and the switching compartment to a refrigerating operation only for the switching compartment will now be described. During a freezing operation for both the freezing compartment 360 and the switching compartment 340, the freezing compartment damper 363 and the duct damper 365 are opened while the freezing compartment evaporator 362 is operated. One or both of the fans 364 and 354 may also be operated. Further, the temperatures in the switching compartment 340 and freezing compartment 360 can be controlled by selectively opening and closing the dampers 365 and 363.

When the switching compartment is to be switched over to a refrigerating operation, the switching compartment duct 346 is separated from the freezing compartment duct 366 at the connecting hole 367 by closing the duct damper 365. Thereafter, the heater 356 is operated and the light source 145 is turned on. As a result, the freezing compartment 360 continuously performs a freezing operation, whereas the switching compartment 340 heats up to prepare for a refrigerating operation. The switching compartment blowing fan 354 operates to blow heated air from the duct 346 into the switching compartment 340, to allow the heat generated from the heater 356 to be more efficiently supplied into the switching compartment 340.

Subsequently, the temperature sensor 149 will detect that the interior temperature of the switching compartment 340 has reached a preset refrigeration-storage temperature. If the interior temperature of the switching compartment 340 reaches the preset refrigeration-storage temperature, the operation of the heater 356 is stopped.

Thereafter, the temperature of the switching compartment 340 is adjusted by controlling the duct damper 365. For example, as the controller adjusts the operation and suspension of the freezing compartment evaporator 362, the opening time or opening period of the duct damper 365 is controlled so that the temperature of the switching compartment 340 can be adjusted.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although numerous embodiments have been described, it should be understood that numerous other modifications and embodiments can be devised by those skilled in the art that will fall within the spirit and scope of the principles of this disclosure. More particularly, variations and modifications are possible in the component parts and/or arrangements which would fall within the scope of the disclosure, the drawings and the appended claims. In addition to variations and modifications in the component parts and/or arrangements, alternative uses will also be apparent to those skilled in the art.

What is claimed is:

1. A refrigerator, comprising:

a housing;

a refrigerating compartment;

a freezing compartment;

a switching compartment that can maintain temperatures ranging between a refrigerating temperature and a freezing temperature;

a first evaporator mounted adjacent the refrigerating compartment, wherein cool air produced by the first evaporator is blown into the refrigerating compartment to maintain the refrigerating compartment at a target temperature;

a second evaporator mounted adjacent the freezing compartment and the switching compartment, wherein cool air produced by the second evaporator is selectively blown into the freezing and switching compartments to maintain the freezing and switching compartments at respective target temperatures; and a light source mounted in the switching compartment so as to selectively emit light and raise the temperature of the switching compartment from the freezing temperature to the refrigerating temperature.

2. The refrigerator of claim 1, wherein when the switching compartment is changed from the freezing temperature to the refrigerating temperature, the light source remains on, to thereby heat an interior of the switching compartment, until the switching compartment is heated to the refrigerating temperature.

3. The refrigerator of claim 1, further comprising a heater located outside the switching compartment.

4. The refrigerator of claim 3, wherein heat from the heater and heat from the light source are simultaneously used to heat the switching compartment from the freezing temperature to the refrigerating temperature.

5. The refrigerator of claim 1, further comprising:

a duct located between a rear wall of the housing and rear walls of the freezing and switching compartments, wherein the second evaporator is mounted in the duct;

a switching compartment discharge hole located in the rear wall of the switching compartment, wherein the switching compartment discharge hole allows air in the duct to enter the switching compartment; and a freezing compartment discharge hole located in the rear wall of the freezing compartment, wherein the freezing compartment discharge hole allows air in the duct to enter the freezing compartment.

6. The refrigerator of claim 5, further comprising a switching damper that selectively opens and closes the switching compartment discharge hole.

7. The refrigerator of claim 6, further comprising a freezing damper that selectively opens and closes the freezing compartment discharge hole.

8. The refrigerator of claim 7, wherein a heater is mounted in the duct.

9. The refrigerator of claim 5, wherein a duct damper is located in the duct between the switching compartment discharge hole and the freezing compartment discharge hole, and wherein the second evaporator is located in a portion of the duct that includes the freezing compartment discharge hole.

10. The refrigerator of claim 9, further comprising:

a switching compartment fan located in the duct adjacent the switching compartment discharge hole, wherein the switching compartment fan blows air from the duct into the switching compartment; and a freezing compartment fan located adjacent the freezing compartment discharge hole, wherein the freezing compartment fan blows air from the duct into the freezing compartment.

11. The refrigerator of claim 10, further comprising a heater located in a portion of the duct adjacent the switching compartment fan.

12. The refrigerator of claim 1, further comprising:

a switching compartment duct located between a rear wall of the housing and a rear wall of the switching compartment;

a switching compartment discharge hole located in the rear wall of the switching compartment, wherein the switching compartment discharge hole allows air in the switching compartment duct to enter the switching compartment; and a switching compartment evaporator mounted in the switching compartment duct, wherein cool air produced by switching compartment evaporator is selectively blown into the switching compartment to maintain the switching compartment at a target temperature.

13. The refrigerator of claim 12, further comprising a heater mounted in the switching compartment duct, and wherein air heated by the heater is blown into the switching compartment to raise the temperature of the switching compartment from the freezing temperature to the refrigerating temperature.

14. A method of controlling a refrigerator that includes a switching compartment that can selectively maintain either a freezing temperature or a refrigerating temperature, the method comprising:

maintaining the switching compartment at a freezing temperature;

increasing a temperature of the switching compartment from the freezing temperature to the refrigerating temperature, wherein the increasing of the temperature comprises operating a light located within the switching compartment to raise an interior temperature of the switching compartment and blowing air heated by a heater located outside the switching compartment into the switching compartment to raise the temperature of the switching compartment.

15. The method of claim 14, further comprising maintaining the switching compartment at the refrigerating temperature after the increasing of the temperature is performed.

16. A refrigerator, comprising:

a housing;

a refrigerating compartment;

a freezing compartment;

a switching compartment that can maintain temperatures ranging between a refrigerating temperature and a freezing temperature;

a heat source that raises the temperature of the switching compartment from the freezing temperature to the refrigerating temperature;

a switching compartment duct between a rear wall of the housing and a rear wall of the switching compartment;

a switching compartment discharge hole in the rear wall of the switching compartment, wherein air in the switching compartment duct to enter the switching compartment via the switching compartment discharge hole; and a switching compartment evaporator in the switching compartment duct, wherein cool air produced by the switching compartment evaporator is selectively blown into the switching compartment to maintain the switching compartment at a target temperature.

17. The refrigerator of claim 16, further comprising a heater mounted in the switching compartment duct, and wherein air heated by the heater is blown into the switching compartment to raise the temperature of the switching compartment from the freezing temperature to the refrigerating temperature.

18. The refrigerator of claim 16, further comprising:

a first evaporator adjacent the refrigerating compartment, wherein cool air produced by the first evaporator is blown into the refrigerating compartment to maintain the refrigerating compartment at a target temperature; and a second evaporator adjacent the freezing compartment and the switching compartment, wherein cool air produced by the second evaporator is selectively blown into the freezing and switching compartments to maintain the freezing and switching compartments at respective target temperatures.

19. The refrigerator of claim 18, further comprising:

a duct located between a rear wall of the housing and rear walls of the freezing and switching compartments, wherein the second evaporator is in the duct;

a switching compartment discharge hole located in the rear wall of the switching compartment, wherein air in the duct to enter the switching compartment via the switching compartment discharge hole; and a freezing compartment discharge hole located in the rear wall of the freezing compartment, wherein air in the duct to enter the freezing compartment via the freezing compartment discharge hole.

20. The refrigerator of claim 19, wherein a duct damper is located in the duct between the switching compartment discharge hole and the freezing compartment discharge hole, and wherein the second evaporator is located in a portion of the duct that includes the freezing compartment discharge hole.

21. The refrigerator of claim 20, further comprising:

a switching compartment fan located in the duct adjacent the switching compartment discharge hole, wherein the switching compartment fan blows air from the duct into the switching compartment; and a freezing compartment fan located adjacent the freezing compartment discharge hole, wherein the freezing compartment fan blows air from the duct into the freezing compartment.

22. The refrigerator of claim 16, wherein the heat source comprises a light mounted in the switching compartment.

23. The refrigerator of claim 22, wherein the light is switched on to heat an interior of the switching compartment when the switching compartment is changed from the freezing temperature to the refrigerating temperature, regardless of the open or closed state of a door of the switching compartment.

* * * * *